US009929469B2

(12) United States Patent
Iino

(10) Patent No.: US 9,929,469 B2
(45) Date of Patent: Mar. 27, 2018

(54) PATCH ANTENNA DEVICE

(71) Applicant: HARADA INDUSTRY CO., LTD., Tokyo (JP)

(72) Inventor: Shinji Iino, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 109 days.

(21) Appl. No.: 14/612,443

(22) Filed: Feb. 3, 2015

(65) Prior Publication Data

US 2015/0236420 A1 Aug. 20, 2015

(30) Foreign Application Priority Data

Feb. 4, 2014 (JP) ..... 2014-019400

(51) Int. Cl.

| | |
|---|---|
| ***H01Q 1/32*** | (2006.01) |
| ***H01Q 9/04*** | (2006.01) |
| ***H01Q 1/22*** | (2006.01) |
| ***H01Q 23/00*** | (2006.01) |

(52) U.S. Cl.

CPC ..... *H01Q 9/045* (2013.01); *H01Q 1/22* (2013.01); *H01Q 1/3225* (2013.01); *H01Q 1/3233* (2013.01); *H01Q 1/3291* (2013.01); *H01Q 9/0407* (2013.01); *H01Q 9/0428* (2013.01); *H01Q 23/00* (2013.01)

(58) Field of Classification Search

CPC ..... H01Q 9/045; H01Q 9/0428; H01Q 23/00; H01Q 1/22; H01Q 1/3225

USPC ..... 343/702, 894

See application file for complete search history.

(56) References Cited

U.S. PATENT DOCUMENTS

| | | | | |
|---|---|---|---|---|
| 5,565,877 | A * | 10/1996 | Du | H01Q 1/1285 333/24 C |
| 6,630,907 | B1 * | 10/2003 | Ryken | H01Q 1/28 343/700 MS |
| 6,903,687 | B1 * | 6/2005 | Fink | H01Q 9/0407 333/126 |
| 6,972,720 | B2 * | 12/2005 | Shikata | H01Q 9/0407 343/700 MS |

(Continued)

FOREIGN PATENT DOCUMENTS

| | | |
|---|---|---|
| JP | 2006-166041 A | 6/2006 |
| JP | 2006-186881 A | 7/2006 |
| JP | 2009-171567 A | 7/2009 |

*Primary Examiner* — Dameon E Levi
*Assistant Examiner* — Ab Salam Alkassim, Jr.
(74) *Attorney, Agent, or Firm* — Westerman, Hattori, Daniels & Adrian, LLP

(57) ABSTRACT

A vehicle-mounted patch antenna device includes a substrate, a ground conductor provided on the substrate, an antenna element section, a stub, and a notification circuit section. The antenna element section is provided on a surface that faces a surface on which the ground conductor of the substrate is provided, and includes a power feeding section and a degeneracy separation element section. The stub is provided on a surface on which the antenna element section of the substrate is provided, and is a microstrip line that uses the ground conductor. The notification circuit section is provided on the substrate, and is connected adjacent to an area in which current distribution is minimum in a peripheral area other than an area in which the power feeding section of the antenna element section is provided.

6 Claims, 4 Drawing Sheets

(56) References Cited

U.S. PATENT DOCUMENTS 7,046,203 B2 * 5/2006 Yuanzhu ..... H01Q 1/243 343/700 MS
7,129,895 B2 * 10/2006 Morris ..... H01Q 9/0407 343/700 MS
7,164,385 B2 * 1/2007 Duzdar ..... H01Q 9/0428 343/700 MS
7,414,588 B2 * 8/2008 Tateno ..... H01Q 1/1214 343/713
7,501,989 B2 * 3/2009 Fujimoto ..... H01Q 1/22 343/711
8,115,681 B2 * 2/2012 Ryou ..... H01Q 1/38 343/700 MS
8,692,725 B2 * 4/2014 Ilno ..... 343/700 MS
8,760,362 B2 * 6/2014 Fuchs ..... H01Q 5/321 343/893
8,797,230 B2 * 8/2014 Leisten ..... H01Q 1/38 343/700 MS
8,830,128 B2 * 9/2014 Fuchs ..... H01Q 1/38 343/700 MS
9,391,370 B2 * 7/2016 Tzanidis ..... H01Q 1/50
2006/0097934 A1 * 5/2006 Leelaratne ..... H01Q 1/1271 343/713
2006/0187131 A1 * 8/2006 Oshima ..... H01Q 1/1271 343/713
2009/0140927 A1 * 6/2009 Maeda ..... H01Q 9/0407 343/700 MS
2009/0153404 A1 * 6/2009 Ryou ..... H01Q 9/0407 343/700 MS
2009/0295645 A1 * 12/2009 Campero ..... H01Q 1/38 343/700 MS
2010/0001921 A1 * 1/2010 Copeland ..... G06K 7/0008 343/876
2010/0007566 A1 * 1/2010 Kobayashi ..... H01Q 1/1214 343/713
2010/0182210 A1 * 7/2010 Ryou ..... H01Q 1/38 343/722
2010/0265147 A1 * 10/2010 Wakui ..... H01Q 1/3275 343/725
2011/0102269 A1 * 5/2011 Sato ..... H01Q 9/0442 343/700 MS
2011/0260934 A1 * 10/2011 Ilno ..... H01Q 1/06 343/711
2013/0064149 A1 * 3/2013 Huang ..... H01Q 13/10 370/297
2013/0194147 A1 * 8/2013 Yoshioka ..... H01Q 1/38 343/787
2015/0311589 A1 * 10/2015 Yokoyama ..... H01Q 5/35 343/722

* cited by examiner

PATCH ANTENNA DEVICE

BACKGROUND OF THE INVENTION

1. Field of the Invention

The present invention relates to a patch antenna device, and more particularly to a vehicle-mounted patch antenna device that can be reduced in size while performance is improved.

2. Description of the Related Art

Lately, there has been known a patch antenna as an antenna used for a vehicle-mounted device, such as what is called an electronic toll collection system (ETC). The patch antenna is also called a microstrip antenna, which has characteristics of being low in height and having a narrow bandwidth. The patch antenna has a structure in which an antenna element is disposed on a ground conductor with a substrate and an air layer provided between them.

There also exists an antenna device that includes electric circuits, such as a light-emitting diode and a speaker, incorporated in the antenna device, and has a function of notifying operation, a state, and the like of the antenna device, like antenna devices described in Patent Document 1 and Patent Document 2. In a microstrip antenna attached with a light-emitting diode disclosed in Patent Document 1, there is provided a light-emitting diode in a location in which a potential difference between an antenna element and a ground conductor is minimum when the antenna element resonates. In this manner, an area of a substrate around an outer side of the antenna element is reduced. In a speaker-integrated antenna disclosed in Patent Document 2, a piezoelectric ceramic member is adhered to a ground conductor. In this manner, the ground conductor is allowed to have a function as a speaker in pursuit of reduction in size of the antenna device. A speaker circuit is connected to a power feeding point of the antenna element.

In a vehicle-mounted patch antenna device described in Patent Document 3 filed by the same applicant as the present application, an antenna element section is provided on a surface facing a surface on which a ground conductor is provided of a substrate. A notification circuit section provided on a side of the surface on which the ground conductor is provided is connected adjacent to an area where current distribution is minimum in a peripheral area other than an area in which a power feeding section of the antenna element section is provided.

CITATION LIST

Patent Document

[Patent Document 1] Japanese Patent Application Kokai Publication No. 2006-166041

[Patent Document 2] Japanese Patent Application Kokai Publication No. 2006-186881

[Patent Document 3] Japanese Patent Application Kokai Publication No. 2009-171567

However, in the antenna device described in Patent Document 1, the light-emitting diode needs to be provided in a location where a potential difference between an antenna element and a ground conductor is minimum, more specifically, adjacent to a center of an antenna element. Accordingly, degree of freedom in installation of the light-emitting diode has been low, and degree of freedom in designing has been low when the antenna device is used for an ETC antenna and the like. An ETC antenna device is normally used by being adhered to a windshield. An antenna element is provided on the windshield side, and notification sections, such as the light-emitting diode and a speaker, are provided on an opposite side of the windshield side, that is, a driver's seat side. There is also the case where a state of the antenna device needs to be notified by light and sound by combining the light-emitting diode and the speaker. However, in the antenna device described in Patent Document 1, the light-emitting diode is provided adjacent to a center of the antenna element or the ground conductor. Accordingly, the speaker and the light-emitting diode are difficult to dispose on the same surface while size is reduced. Therefore, the light-emitting diode and the speaker have been difficult to use in combination.

In the antenna device described in Patent Document 2, an antenna element needs to be disposed in air, and there has been a problem in position accuracy, an assembly characteristic, and durability. Since the antenna element is disposed in air by being isolated from a substrate on which a ground conductor is provided, reduction in thickness of an antenna section has been difficult.

In the antenna device described in Patent Document 3, a signal from a cable has been supplied to an antenna element section, and a notification circuit section has been connected through a coil that filters a microwave signal. As the coil, a chip coil has been employed. However, a chip coil has been disposed on an antenna element section side, and the notification circuit section, for example, an LED or the like, has been disposed on a ground conductor side. Accordingly, components have necessarily been soldered on both surfaces of a substrate, and manufacturing cost has been increased. When an attempt has been made to dispose the chip coil on the ground conductor side, the ground conductor has necessarily been made small. Accordingly, there has been possibility that an antenna characteristic is deteriorated.

SUMMARY OF THE INVENTION

Under the circumstances, the present invention provides a vehicle-mounted patch antenna device that can be reduced in size and have multiple functions with reduced manufacturing cost.

A patch antenna device mounted on a vehicle may comprise a substrate; a ground conductor provided on the substrate; an antenna element section provided on a surface facing a surface on which the ground conductor of the substrate is provided, the antenna element section including a power feeding section and a degeneracy separation element section; a stub provided on a surface on which the antenna element section of the substrate is provided, and being a microstrip line that uses the ground conductor; and a notification circuit section for notifying a state to an outside, provide on the substrate, and connected, through the stub, adjacent to an area in which current distribution is minimum in a peripheral area other than an area in which the power feeding section of the antenna element section is provided.

The substrate may be made from a high dielectric material that increases a wavelength shortening rate in order to reduce size of the antenna element section, and the stub may be disposed in a space that is generated when the antenna element section is reduced in size.

The notification circuit section may be provided on the surface on which the ground conductor of the substrate is provided.

The notification circuit section may include a light-emitting diode and/or a speaker.

The patch antenna device of the present invention has advantages that can be reduced in size and have multiple functions as compared to the antenna device in which a notification circuit section is connected to a power feeding section by connecting the notification circuit section to an area other than that of the power feeding section while manufacturing cost is restricted by arranging a component only on a ground conductor side.

BRIEF DESCRIPTION OF DRAWINGS

FIG. 1A is a top view of FIG. 1, FIG. 1B is a bottom view of FIG. 1, and FIG. 1C is a transverse cross-sectional view of a state in which a cable is connected to the antenna device;

FIG. 6A is a top view in which a recessed section is provided as a degeneracy separation element section, and FIG. 6B is a top view in which a projection section is provided as the degeneracy separation element section; FIG. 7A is a perspective view of FIG. 7, and FIG. 7B is a transverse cross-sectional view of FIG. 7.

PREFERRED EMBODIMENTS OF THE INVENTION

Figure 1A:
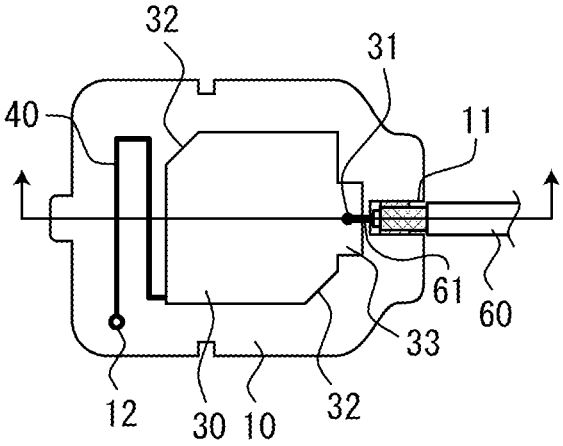
FIGS. 1A-1C are schematic views for explaining a vehicle-mounted patch antenna device of the present invention, where
Figure 1B:
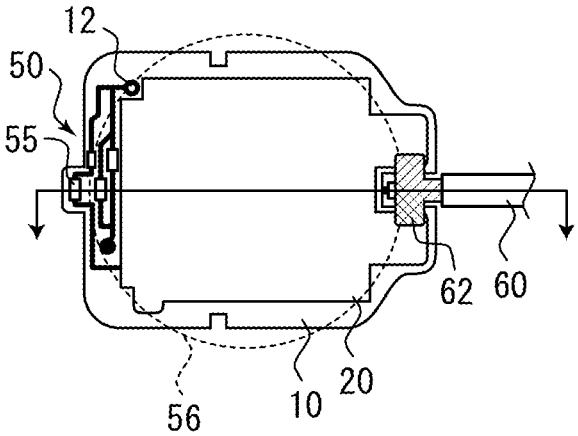
Figure 1C:
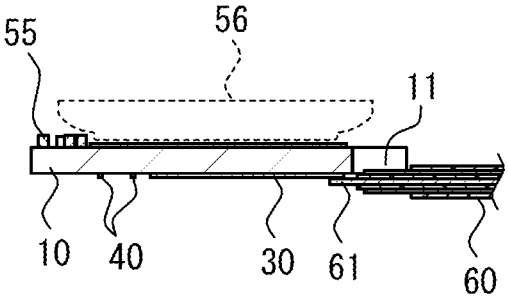

Preferred embodiments of the present invention will be described below with reference to the accompanying drawings. FIG. 1 is a schematic view for explaining a vehicle-mounted patch antenna device of the present invention. FIG. 1A is a top view of FIG. 1. FIG. 1B is a bottom view of FIG. 1. FIG. 1C is a transverse cross-sectional view of a state where a cable is connected to the antenna device. In the present description, for convenience of description, a side of a substrate on which an antenna element is disposed will be referred to as a front surface, and a side on which a ground conductor is disposed will be referred to as a back surface.

The patch antenna device of the present invention includes, as main constituents, a substrate 10, a ground conductor 20, an antenna element section 30, a stub 40, and a notification circuit section 50.

The substrate 10 is what is called a printed circuit board, or the like, and made up of, for example, a dielectric material. As the substrate 10, for example, a fluororesin substrate (polytetrafluoroethylene: PTFE), or the like can be used. Preferably, a dielectric constant of the substrate is around 2 to 4. As will be described later, the substrate 10 may be made up of a high dielectric material so as to increase a wavelength shortening rate. Size and a shape of the substrate 10 may be determined in accordance with size of the antenna element 30 and the notification circuit section 50 which will be described later.

Hereinafter, description will be made mainly on an example where the patch antenna device of the present invention is applied to an ETC antenna device. The ETC antenna device uses a microwave signal of, for example, 5.8 GHz. In the patch antenna device of the present invention, a DC signal for the notification circuit section and a low-frequency signal are superimposed on a microwave signal, and supplied to the antenna device through a coaxial cable 60.

The patch antenna device and, for example, a vehicle-mounted ETC device (not shown) are connected by the cable 60, such as a coaxial cable. As shown in FIG. 1C, in order to set a core 61 of the cable 60 and a surface of the substrate 10 at the same level when viewed from the side, a notch section 11 is provided on the substrate 10 as shown in FIGS. 1A and 1B. In the illustrated example, the notch section 11 is provided on a projection section on a side of the substrate 10 on which the cable 60 is connected. The notch section 11 has a notch width that is as large as allowing fitting of a protective film of the cable 60. To the notch section 11, the cable 60 is fitted, and is adjusted so that the core 61 of the cable 60 and a surface of the substrate 10 are set at the same level. In this manner, work efficiency of connecting the core 61 of the cable 60 to a power feeding section 31 on the substrate 10 by soldering is improved.

On the back surface side of the substrate 10, there is provided the ground conductor 20 made from a conductive body, such as a copper foil. The ground conductor 20 is provided to cover almost the entire back surface of the substrate 10. The ground conductor 20 extends to the periphery of the notch section 11. A ground line 62 of the cable 60 fitted to the notch section 11 is connected to the ground conductor on the periphery of the notch section 11 by soldering and the like.

On the front surface of the substrate 10, that is, a surface that faces a surface on which the ground conductor 20 is provided, there is provided the antenna element section 30 made from a conductive body, such as a copper foil. The ground conductor 20 and the antenna element section 30 may be formed by etching a double-sided printed circuit board.

The antenna element section 30 shown in FIG. 1 is one-point power feeding type circularly polarized wave patch antenna, and is provided with the power feeding section 31 and a degeneracy separation element section 32. More specifically, the antenna element section 30 includes a main section that has a substantially square shape, in which each side has a length of $\lambda/2$. To generate a circularly polarized wave, the degeneracy separation element sections 32 are loaded in diagonal corner areas of the main section. The degeneracy separation element section 32, which shifts a balance of two orthogonal polarized waves that are generated in the antenna element section, may be a notch, a projection section, or the like. The power feeding section 31 is disposed on a center line of the antenna element section 30.

In the illustrated example, to adjust an input impedance, an impedance adjustment section 33 is provided in a peripheral section by a pattern projecting from the antenna element. The impedance adjustment section 33 adjusts an input impedance with the vehicle-mounted ETC device. An input impedance is adjusted based on a width and a length (area)

of the impedance adjustment section 33. The power feeding section 31 is disposed in the impedance adjustment section 33.

Figure 2A:
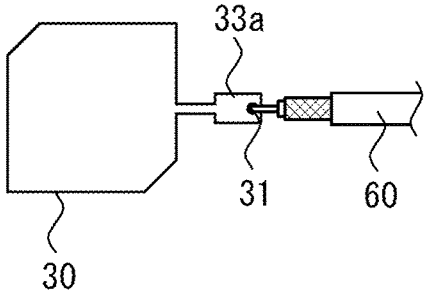
FIGS. 2A-2B are top views showing the periphery of an antenna element section for explaining another example of an impedance adjustment section of the patch antenna device of the present invention.
Figure 2B:
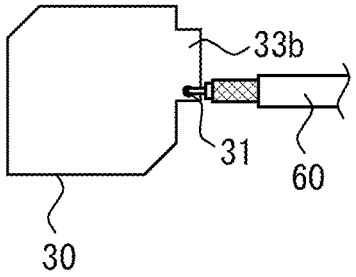

In the illustrated example, the impedance adjustment section 33 is disposed symmetrically with respect to a center line of the antenna element section 30. However, the present invention is not limited to the above. By using FIG. 2, description will be made on another example of the impedance adjustment section. FIG. 2 is a top view showing the periphery of the antenna element section for explaining another example of the impedance adjustment section of the patch antenna device of the present invention. In the drawing, the same reference numerals as those in FIG. 1 denote the same parts as those in FIG. 1, and are omitted from detailed description. As shown in FIG. 2A, an impedance adjustment section 33*a* may exist between the cable 60 and the antenna element section 30, and is disposed at a position away from the antenna element section 30. As shown in FIG. 2B, the impedance adjustment section 33*b* may also be disposed by being shifted horizontally from a center line of the antenna element section 30. In any case, in the circularly polarized wave patch antenna of a one-point power feeding type, the power feeding section 31 is disposed on a center line of the antenna element section 30 in principle. However, there is the case where the power feeding section is offset within a range of adjustment.

Referring back to FIG. 1, the cable 60 is fixed by a projection pattern of the impedance adjustment section 33 and the ground conductor 20 on the back surface side. As needed, a ground pattern to which a ground line of the cable 60 can be connected may be provided adjacent to the periphery of the notch 11 on the front surface side of the substrate 10. Measures to prevent pull-out of the cable may be taken separately.

To the antenna element section 30, there is connected the notification circuit section 50 through the stub 40. The stub 40 is provided on the front surface of the substrate 10, that is, the surface on which the antenna element section 30 is provided. More specifically, the stub 40 only needs to be formed into a predetermined shape by etching a double-sided printed circuit board. The illustrated example shows the stub having a folded shape. The stub 40 is a microstrip line by using the ground conductor 20 provided on the back surface of the substrate 10.

Figure 3A:
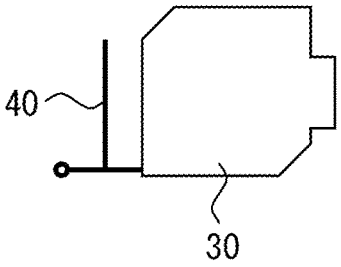
FIGS. 3A-3C are top views showing the periphery of the antenna element section for explaining another example of a stub of the patch antenna device of the present invention.
Figure 3B:
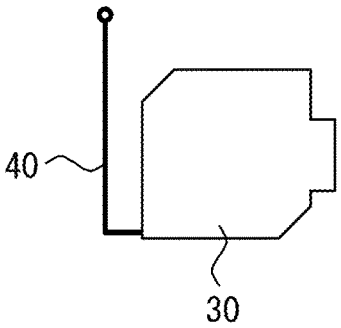
Figure 3C:
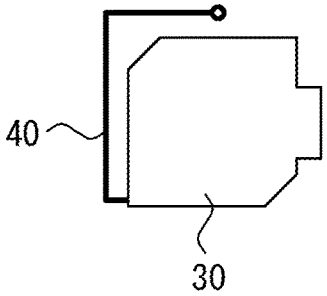

Description will be made on another example of the stub by using FIG. 3. FIG. 3 is a top view showing the periphery of the antenna element section for explaining another example of the stub of the patch antenna device of the present invention. The example shown in FIG. 1 shows the stub 40 having a folded shape. FIG. 3 shows several other examples. For example, FIG. 3A shows an example of a shape, in which a line of the stub 40 projects in parallel with a side of the antenna element section 30 in a path to the notification circuit section 50. FIG. 3B shows an example where the stub 40 extends in parallel to one side of the antenna element section 30, and the notification circuit section 50 is connected to an end section of the stub 40. FIG. 3C shows an example where the stub 40 extends in an L-shape in parallel to two sides of the antenna element section 30, and the notification circuit section 50 is connected to an end section of the stub 40. In any of the examples, the notification circuit section 50 is disposed on the back surface side of the substrate 10. The shape of the stub of the patch antenna device of the present invention is not limited to the specific shape of the illustrated examples described above, and may be any shape as long as the stub is a microstrip line that supplies a signal from the cable to the antenna element section 30, filters and transmits a microwave signal to the notification circuit section 50. A length of the stub 40 may be set as appropriate to a length by which a microwave signal can be filtered.

The notification circuit section 50 notifies a state of the antenna device to the outside, and is provided on the substrate 10. As shown in FIG. 1, in the patch antenna device of the present invention, a signal from the cable 60 passes through the antenna element section 30, and is connected to the notification circuit section 50 through the stub 40. The notification circuit sections 50 include, for example, a light-emitting diode 55 as a notification section, a speaker 56, and a circuit section as a peripheral circuit of the light-emitting diode 55 and the speaker 56. The notification circuit section 50 is disposed on the back surface side by using a through-hole 12 provided on the substrate 10 as needed at an end section of the stub 40. The illustrated example shows the patch antenna device including the light-emitting diode and the speaker. However, the present invention is not limited to the above, and the patch antenna device may be one that includes only the light-emitting diode, or one that includes only the speaker. In the patch antenna device of the present invention, the notification circuit section is not limited to the light-emitting diode and the speaker, and may be any device as long as the device can notify a state of the antenna device, such as a liquid crystal monitor.

Figure 4:
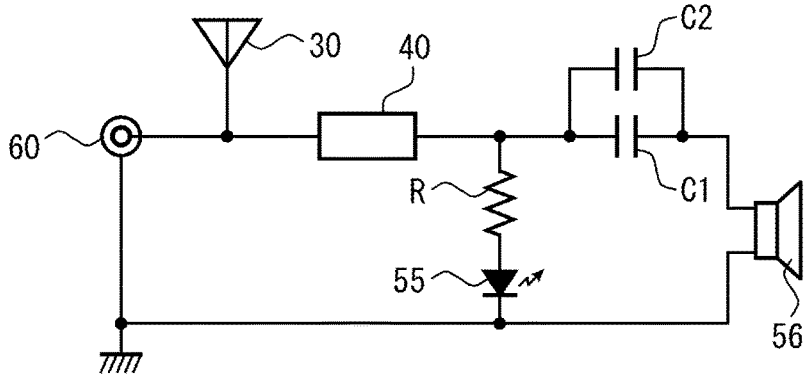
FIG. 4 is an equivalent circuit diagram when notification circuit sections include a light-emitting diode and a speaker.

FIG. 4 shows an equivalent circuit diagram when the notification circuit section includes a light-emitting diode (LED) and a speaker. As illustrated, the notification circuit section 50 supplies a signal from the cable 60 to the antenna element section 30, and to a DC circuit side through the stub 40 for filtering a microwave signal. The DC circuit side includes a light-emitting diode side circuit including a resistor R1 and a light-emitting diode 55, and a low-frequency circuit (speaker side circuit including capacitors C1 and C2 and a speaker 56).

Figure 5:
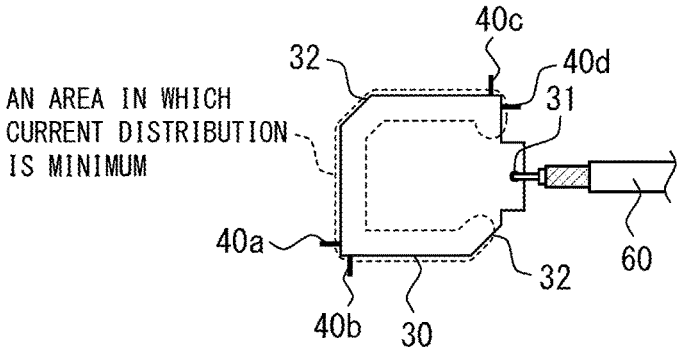
FIG. 5 is a top view showing the periphery of the antenna element section for explaining current distribution of the patch antenna device of the present invention.

The notification circuit section 50 is connected adjacent to an area where current distribution is minimum in a peripheral area other than an area where the power feeding section 31 of the antenna element section 30 is provided. Description will be made on a position at which the notification circuit section 50 is connected by using FIG. 5. FIG. 5 is a top view showing the periphery of the antenna element section for explaining a concept of current distribution of the patch antenna device of the present invention. In the drawing, the same reference numerals as those in FIG. 1 denote the same parts as those in FIG. 1, and are omitted from detailed description. In the circularly polarized wave patch antenna of a one-point power feeding type, in current distribution generated on the antenna element section 30, there exists an area where current distribution is minimum near a peripheral area of surrounding sides other than the power feeding point of the antenna element section (an area enclosed by a dotted line in the drawing). The area in which current distribution is minimum is an area where a current flowing on the antenna that rotates as time elapses is kept at substantially zero at all times. Current distribution is higher adjacent to a center of the antenna element section than a peripheral area. In the patch antenna device of the present invention, a circuit of the notification circuit section 50 is connected adjacent to the area where current distribution is minimum. The connection position only needs to be adjacent to the area where current distribution is minimum. Accordingly, the connection position is not necessarily limited to a position at which current distribution is minimum.

More specifically, in the circularly polarized wave patch antenna of a one-point power feeding type having a square shape shown in FIG. 5, for example, areas in which current distribution is minimum are adjacent to a corner section area in which the degeneracy separation element section 32 is provided and adjacent to an corner section area in which the degeneracy separation element section 32 is not provided. Accordingly, the notification circuit section 50 may be connected adjacent to the above areas.

In FIG. 1A, the notification circuit section 50 is connected adjacent to a left side of a lower left corner of the antenna element section 30. However, the present invention is not limited to the above configuration as long as the notification circuit section 50 is connected adjacent to an area in which current distribution is minimum. That is, for example, as shown in FIG. 5, the notification circuit section 50 may also be connected adjacent to a lower side 50*b* of a lower left corner, to an upper side 50*c* and to a right side 50*d* of an upper right corner, and the like, in addition to the left side 50*a* in a lower left corner of the antenna element section 30. As described above, when the degeneracy separation element sections 32 are mounted in a peripheral area of the antenna element section in a manner facing each other across the antenna element section 30, the notification circuit section 50 only needs to be connected to some area adjacent to a peripheral area of the antenna element section 30. The notification circuit section 50 may also be connected adjacent to a corner section area in which the degeneracy separation element section 32 is provided. Description has been made only on the example where the notification circuit section 50 is connected adjacent to a corner section (a position shifted from a corner section). However, the present invention is not limited to the above, and the notification circuit section 50 may be connected to the corner section itself. The position to which the notification circuit section 50 is connected is not limited to the corner section, as long as the position is adjacent to an area in which current distribution is minimum in a peripheral area other than an area in which a power feeding section of the antenna element section is provided.

Figure 6A:
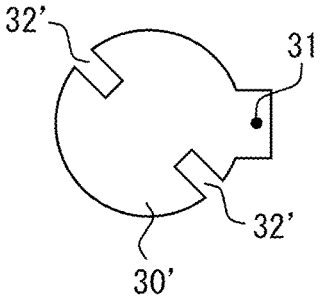
FIGS. 6A-6B are diagrams for explaining another shape of the antenna element section of the patch antenna device of the present invention, where
Figure 6B:
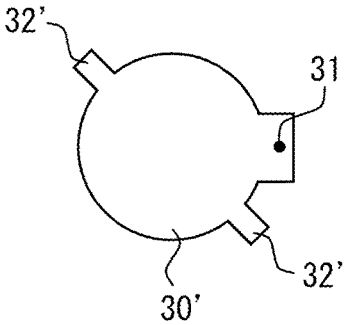

FIG. 1 illustrates the configuration in which a shape of the antenna element section is square. However, the present invention is not limited to the above, and the shape only needs to be a shape by which a circularly polarized wave can be transmitted and received. For example, the shape of the antenna element section may be circular. FIG. 6 is a diagram for explaining another shape of the antenna element section of the patch antenna device of the present invention. FIG. 6A is a top view in which a recessed section is provided as a degeneracy separation element section. FIG. 6B is a top view in which a projection section is provided as the degeneracy separation element section. In the drawing, the same reference numerals as those in FIG. 1 denote the same parts as those in FIG. 1, and omitted from detailed description. The antenna element section having the above shape can also transmit and receive a circularly polarized wave. Just like the case of the antenna element section having a square shape, an area in which current distribution is minimum exists adjacent to peripheral areas of surrounding sides other than a power feeding point of the antenna element section.

The patch antenna device of the present invention may also be one that includes an antenna element section that can transmit and receive a linearly polarized wave instead of a circularly polarized wave. For the linearly polarized wave, the antenna element section only needs to be an element section having a square shape that does not include a degeneracy separation element section. In this case, an area in which a current is minimum is at a position adjacent to a peripheral area of a side facing a side on which the power feeding section is provided.

According to the present invention, the notification circuit section is connected around an area in which current distribution is minimum of the antenna element section. In this manner, degree of freedom in layout is high and the device can be reduced in size.

Referring back to FIG. 1, in the patch antenna device of the present invention, the notification circuit section 50 is connected adjacent to an area in which current distribution is minimum adjacent to a corner section of the antenna element section 30. Accordingly, constituents of the notification circuit section 50 can be disposed along a peripheral section. As has been described by using FIG. 5, in the patch antenna device of the present invention, degree of freedom of a connection position of the notification circuit section 50 is high. For this reason, degree of freedom of arrangement layout on the substrate 10 is also high, and the patch antenna device can be reduced in size.

As shown in FIG. 1C, the light-emitting diode 55 and the speaker 56 as the notification section of the notification circuit section 50 are disposed on a side of a surface on which the ground conductor 20 is provided, that is, on the back surface side of the substrate 10, together with elements, such as a capacitor which is a circuit section. On a side of a surface on which the antenna element section 30 is provided, that is, on the front surface side of the substrate 10, only the stub 40 is disposed. Accordingly, an element and the like do not need to be disposed on the front surface side by soldering. In this manner, manufacturing cost can be restricted.

As shown in the illustrated example, the light-emitting diode 55 may also be disposed in a projection section provided on the substrate 10 so that the light-emitting diode 55 and the speaker 56 do not overlap with each other vertically in FIG. 1C. In this manner, when viewed from the side on which the speaker 56 is disposed, light from the light-emitting diode 55 does not receive influence from the speaker 56. The speaker 56 and the ground conductor 20 may be insulated by an insulation sheet and the like as appropriate.

The ground conductor 20 is normally provided to cover almost the entire back surface of the substrate, and the antenna element section 30 is provided in an area smaller than the entire back surface. Accordingly, a peripheral marginal section on which the antenna element section 30 of the substrate is provided is at a position overlapping with the ground conductor 20 in a vertical relationship when viewed from the side surface. Accordingly, the stub 40 may be disposed in the marginal section. In this manner, the stub 40 is a microstrip line using the ground conductor 20. The substrate 10 may also be configured with a high dielectric material that increases a wavelength shortening rate in order to reduce size of the antenna element section 30. With an increased wavelength shortening rate, the antenna element section 30 can be reduced in size. The stub 40 may be disposed in space that is generated when the antenna element section 30 is reduced in size. By the above configuration, the ground conductor 20 can be made larger relative to the antenna element section 30. Accordingly, an antenna characteristic is improved, and space for disposing the stub 40 can be ensured to be provided.

When in use, the patch antenna device of the present invention is adhered, for example, to a windshield of a vehicle, more specifically, to the windshield from the inside of the vehicle. Accordingly, the side on which the antenna element section 30 is provided faces the windshield side, and the side on which the light-emitting diode 55 and the speaker 56 as the notification sections are provided faces the inside of the vehicle.

Figure 7A:
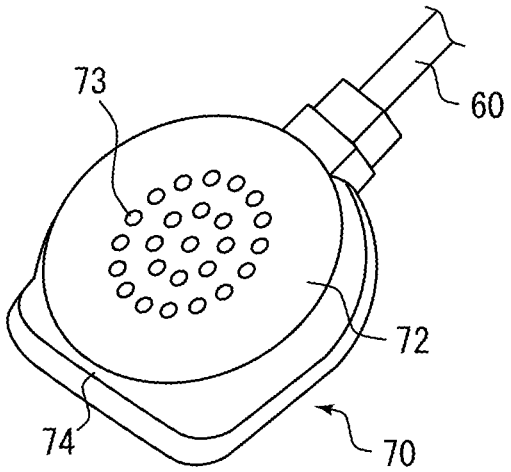
FIGS. 7A-7B are diagrams showing a state where the patch antenna device of the present invention is in use, where
Figure 7B:
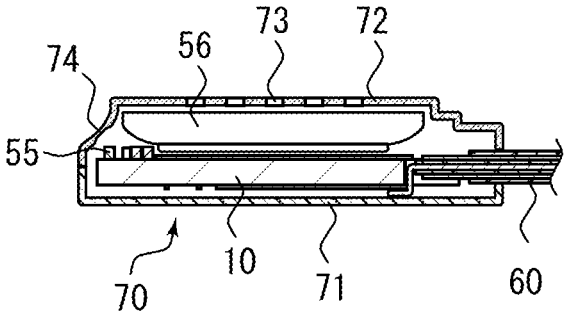

Description will be made on the patch antenna device of the present invention in a state of being covered with a housing by using FIG. 7. FIG. 7 is a diagram showing a state where the patch antenna device of the present invention is in use. FIG. 7A shows a perspective view of FIG. 7. FIG. 7B shows a transverse cross-sectional view of FIG. 7. In the drawing, the same reference numerals as those in FIG. 1 denote the same parts as those in FIG. 1, and are omitted from detailed description. As illustrated, the substrate 10, the light-emitting diode 55, the speaker 56, and the like are covered with a housing 70. The housing 70 defines an outer shape of the patch antenna device. The housing 70 includes a base housing 71 that covers a side of the surface on which the antenna element section 30 is provided and a transparent housing 72 that covers a side of the surface on which the notification sections including the light-emitting diode 55 and the speaker 56 are provided. The base housing 71 is made from a material through which an electromagnetic wave emitted from the antenna element section 30 passes, which may be, for example, ABS resin. The base housing 71 is adhered to, for example, a windshield of a vehicle from the inside of the vehicle. The transparent housing 72 is made from a transparent or translucent material, which may be, for example, polycarbonate, epoxy resin, acrylic resin, and ABS resin. The base housing 71 may also be formed with a transparent or translucent material, like the transparent housing 72.

The transparent housing 72 is provided with a plurality of holes 73, through which sound of the speaker 56 passes. For the patch antenna device in which only the light-emitting diode 55 is used and the speaker 56 is not used for the notification section, the holes 73 do not need to be provided.

A section 74 corresponding to a position of the light-emitting diode 55 of the transparent housing 72 is formed to be thin as compared to the other sections, and allows light emitted from the light-emitting diode 55 to pass through well. For the section corresponding to the position of the light-emitting diode 55 of the transparent housing 72, a lens section having a lens effect may be provided instead of making the section thin. The lens section may be provided by integrally forming a thickness of the transparent housing 72 into a convex lens shape. By the above configuration, light emitted from the light-emitting diode 55 is condensed, and visibility is improved. As described above, the section 74 corresponding to the position of the light-emitting diode 55 can be integrally formed with the transparent housing 72, which facilitates manufacture and assembly.

In the illustrated example, the cable 60 is fitted to a notch section of the substrate 10, and a core of the cable 60 is bent and connected to the power feeding section, so that the cable 60 is contained in the housing 70 as appropriate. However, the present invention is not limited to the above configuration, and the core of the cable 60 and the substrate 10 may be set at the same level as shown in FIG. 1C.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A patch antenna device mounted on a vehicle, the patch antenna device comprising:

a substrate;

a ground conductor provided on the substrate;

an antenna element section provided on a surface facing a surface on which the ground conductor of the substrate is provided, the antenna element section including a power feeding section and a degeneracy separation element section;

a stub configured to filter a microwave signal, provided on a surface on which the antenna element section of the substrate is provided, and being a microstrip line that uses the ground conductor; and a notification circuit section for notifying a state to an outside, provided on the substrate, and connected, through the stub, adjacent to an area in which current distribution is minimum in a peripheral area other than an area in which the power feeding section of the antenna element section is provided, wherein a DC signal for the notification circuit section and a low-frequency signal are superimposed on the microwave signal, and on a side of the surface on which the antenna element section is provided, only the stub is disposed.

2. The patch antenna device according to claim 1, wherein the substrate is made from a high dielectric material that increases a wavelength shortening rate in order to reduce size of the antenna element section, and the stub is disposed in a space that is generated when the antenna element section is reduced in size.

3. The patch antenna device according to claim 1, wherein the notification circuit section is provided on the surface on which the ground conductor of the substrate is provided.

4. The patch antenna device according to claim 1, wherein the notification circuit section includes a light-emitting diode or a speaker.

5. The patch antenna device according to claim 2, wherein the notification circuit section is provided on the surface on which the ground conductor of the substrate is provided.

6. The patch antenna device according to claim 2, wherein the notification circuit section includes a light-emitting diode or a speaker.

* * * * *